US010359199B2

(12) United States Patent
Kim

(10) Patent No.: US 10,359,199 B2
(45) Date of Patent: Jul. 23, 2019

(54) ROASTER USABLE AS STOVE

(71) Applicant: Young Jae Kim, Gangwon-do (KR)

(72) Inventor: Young Jae Kim, Gangwon-do (KR)

( * ) Notice: Subject to any disclaimer, the term of this patent is extended or adjusted under 35 U.S.C. 154(b) by 289 days.

(21) Appl. No.: 15/479,462

(22) Filed: Apr. 5, 2017

(65) Prior Publication Data

US 2018/0292091 A1 Oct. 11, 2018

(51) Int. Cl.
*F24C 3/14* (2006.01)
*F24C 3/08* (2006.01)

(52) U.S. Cl.
CPC . *F24C 3/14* (2013.01); *F24C 3/08* (2013.01)

(58) Field of Classification Search
CPC .. F24C 3/085; F24C 3/126; F24C 3/08; F24C 3/087; F24C 15/107; F24C 3/002; F24C 3/06; F24C 3/062; F23N 2041/08; A47J 37/0713
USPC ..... 126/4, 1 R, 39 R, 41 R, 39 D, 39 E; 99/340, 357, 449
See application file for complete search history.

(56) References Cited

U.S. PATENT DOCUMENTS 3,413,912 A * 12/1968 Phelan ..... A47J 37/06 126/41 R
5,237,912 A * 8/1993 Fins ..... A47J 33/00 126/41 R
6,435,863 B2 * 8/2002 Damrath ..... F24C 3/085 126/39 E

* cited by examiner

*Primary Examiner* — Vivek K Shirsat
*Assistant Examiner* — Ko-Wei Lin
(74) *Attorney, Agent, or Firm* — Novick, Kim & Lee, PLLC; Jae Youn KIm

(57) ABSTRACT

Provided is a roaster usable as a stove. The roaster includes a drip pan guide unit, a first gas burner unit hingedly connected with one side wall of the drip pan guide unit and provided at one surface thereof with insertion guide members, a second gas burner unit hingedly connected with an opposite side wall of the drip pan guide unit and provided at one surface thereof with insertion guide members, and a heat guide unit formed in a reverse "U" shape having an open left surface, an open right surface and an open bottom surface, and having a gridiron insertion slot formed in a top surface thereof and insertion protrusions formed at edge portions thereof. When the first and second gas burner units are rotated and maintained in an upright standing state, the insertion protrusions are inserted into or withdrawn out of the insertion guide members.

1 Claim, 5 Drawing Sheets

ROASTER USABLE AS STOVE

BACKGROUND OF THE INVENTION

Field of the Invention

The present invention relates to a roaster that is usable as a stove, and more particularly to a roaster that is usable as a stove, which is capable of being transformed between a stove for heating a surrounding space and a burner for cooking food outdoors or indoors by simple manipulation on the part of a user, which is capable of also serving as a roaster for roasting food or an oven for heating food, and which is easily disassembled and assembled, leading to convenience in carrying or storing the same.

Description of the Related Art

A conventional roaster that is usable as a stove is disclosed in Korean Utility Model Publication No. 20-2012-0005098 (dated on Jul. 12, 2012).

This conventional roaster that is usable as a stove includes casters mounted to a lower portion of a main body to improve movability and transportability, a roasting unit integrally formed at an upper portion of the main body to roast meat without the necessity for a separate roasting plate, and shelves provided at both lateral portions of the main body so as to be foldable and unfoldable to improve convenience in use.

In order to accomplish the above objects, the conventional roaster usable as a stove is constructed such that: a main body has an accommodation space formed therein, an inlet port formed in the front surface thereof to put fuel thereinto, a door hingedly coupled thereto to open and close the inlet port, a support tray for supporting the fuel put thereinto, and an exhaust hole formed so as to communicate with the interior thereof; a charcoal storage unit is mounted to a lower portion of the main body so as to be withdrawn forwards; a roasting unit is formed in an upper portion of the main body so as to be downwardly concave; a liquid fat discharge pipe is connected to a lower portion of the roasting unit so as to communicate therewith and extends to the exterior of the main body; and shelves are provided at both lateral portions of the main body in a removable manner or in a foldable and unfoldable manner.

When a fire is set to the charcoal placed on the support tray of the conventional roaster usable as a stove, it is possible to roast various kinds of meat placed on a grill of the roasting unit, to cook food with steam by covering the roasting unit, or to utilize the main body as a stove for heating a surrounding space by putting fuel into the main body in the above-described way when the indoor or outdoor temperature drops. However, the conventional roaster usable as a stove has a structure of merely adding a roasting unit and a grill to an open portion of a well-known stove. Further, because the conventional roaster usable as a stove is constructed without consideration of disassembly and assembly, it is not easy to carry or store the same due to its size and weight. Furthermore, because the conventional roaster usable as a stove has no separate constituent component for facilitating transformation into a stove, a roaster or an oven, it is impossible to realize transformation suitable for respective purposes of use through removal or assembly of constituent components.

SUMMARY OF THE INVENTION

Therefore, the present invention has been made in view of the above problems, and it is an object of the present invention to provide a roaster usable as a stove, which is capable of being conveniently transformed outdoors or indoors by simple manipulation on the part of the user into a stove for heating a surrounding space by erecting a first gas burner unit and a second gas burner unit upright so as to radiate heat laterally, into a burner by laying down the first gas burner unit and the second gas burner unit so as to radiate heat upwards and to cook food placed thereon, into a roaster by rotating the first gas burner unit and the second gas burner unit upwards and maintaining the upright state thereof by interposing a heat guide unit therebetween so as to roast food held by a gridiron that is inserted vertically into the heat guide unit, or into an oven by mounting an oven unit onto the heat guide unit so as to heat food placed in the oven unit.

It is another object of the present invention to provide a roaster usable as a stove that is capable of being easily disassembled and assembled, leading to convenience in carrying or storing the same.

In accordance with the present invention, the above and other objects can be accomplished by the provision of a roaster usable as a stove including a drip pan guide unit formed to have an open top surface and an open rear surface, a drip pan formed in a box shape having an open top surface and configured to be received in or withdrawn out of the drip pan guide unit, a first gas burner unit hingedly connected with one side wall of the drip pan guide unit and provided at one surface thereof with insertion guide members spaced a predetermined distance apart from each other, a second gas burner unit hingedly connected with an opposite side wall of the drip pan guide unit and provided at one surface thereof with insertion guide members spaced a predetermined distance apart from each other, a heat guide unit formed in a reverse "U" shape having an open left surface, an open right surface and an open bottom surface, the heat guide unit having a gridiron insertion slot formed in a top surface thereof and insertion protrusions formed at left-front, left-rear, right-front and right-rear edge portions thereof, and the insertion protrusions being inserted into the insertion guide members so that the first gas burner unit and the second gas burner unit are maintained in an upright standing state or being withdrawn out of the insertion guide members so that the first gas burner unit and the second gas burner unit are rotated from the upright standing state and spread outwards in a horizontal direction, an oven unit formed to have an open bottom surface and openings formed in top and front surfaces thereof, the oven unit including a first door and a second door hingedly connected with outer surfaces of walls thereof in order to open and close the openings, and two opposite lateral walls, each being divided into a plurality of parts hingedly connected with each other so as to be folded inwardly, and the oven unit being provided at an interior thereof with a grill, and an oven support unit mounted below the oven unit in order to support the oven unit, the oven support unit including walls having predetermined heights, an open top surface, and a heat guide slot formed in a lower end portion thereof, and the lower end portion of the oven support unit being inserted into the gridiron insertion slot.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Hereinafter, preferred embodiments of the present invention will be described in detail with reference to the accompanying drawings.

Figure 1:
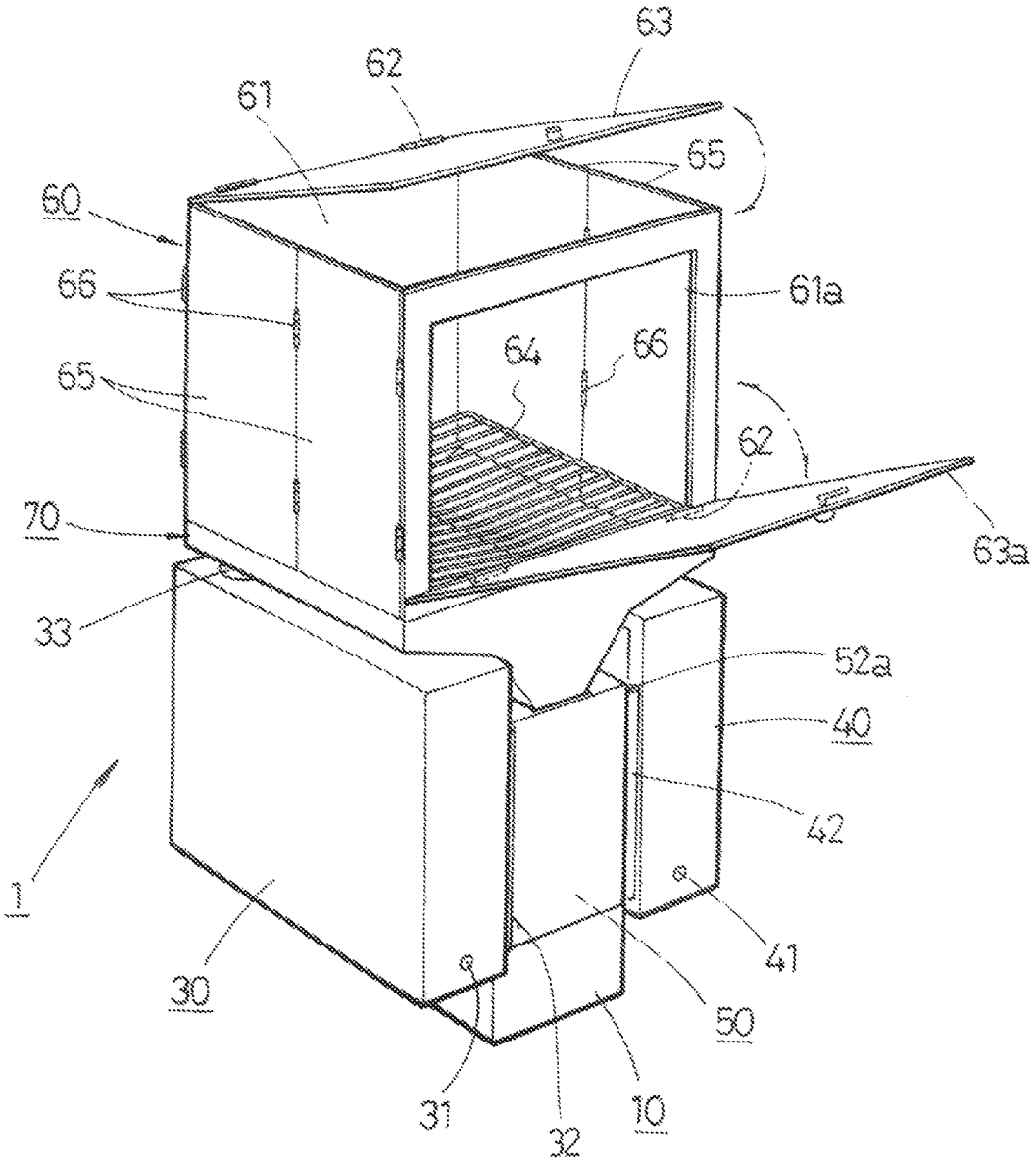
FIG. 1 is a perspective view illustrating the assembled state of a roaster usable as a stove according to the present invention.
Figure 2:
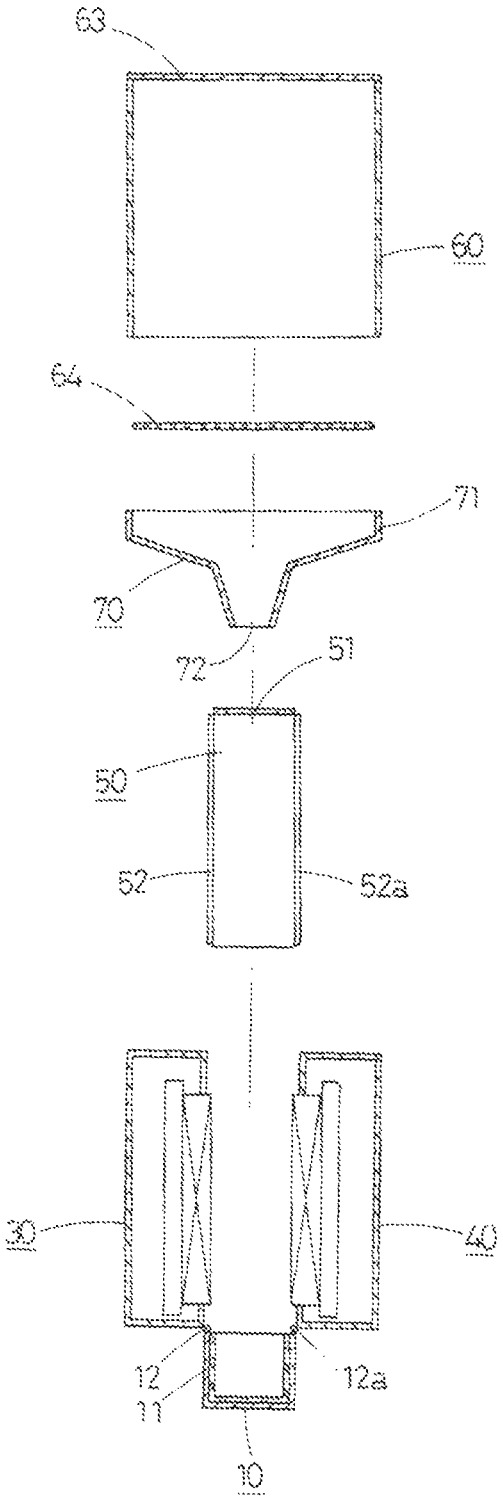
FIG. 2 is a longitudinal-sectional view of the roaster usable as a stove depicted in FIG. 1.

FIG. 1 is a perspective view illustrating the assembled state of a roaster usable as a stove according to the present invention, and FIG. 2 is a longitudinal-sectional view of the roaster usable as a stove depicted in FIG. 1.

As shown in the drawings, a roaster 1 that is usable as a stove according to the present invention comprises a drip pan guide unit 10, a first gas burner unit 30 and a second gas burner unit 40, which are hingedly coupled to both lateral portions of the drip pan guide unit 10, a heat guide unit 50 for maintaining the first gas burner unit 30 and the second gas burner unit 40 in an upright standing state, an oven unit 60 configured to be mounted on the heat guide unit 50, and an oven support unit 70 disposed below the oven unit 60.

The drip pan guide unit 10 is formed to have an open top surface and an open rear surface. The drip pan guide unit 10 accommodates a drip pan 11, which is formed in a box shape having an open top surface and is configured to be received in or withdrawn out of the drip pan guide unit 10.

The first gas burner unit 30 and the second gas burner unit 40 are used with gas as a fuel and may have the same configuration as a well-known burner. Each of the first gas burner unit 30 and the second gas burner unit 40 is provided at a portion thereof with a respective one of connectors 31 and 41, through which gas is supplied thereto.

The first gas burner unit 30 and the second gas burner unit 40 are connected with the drip pan guide unit 10 by means of a plurality of hinges 12 and 12*a* while interposing the drip pan guide unit 10 therebetween. Therefore, a user can rotate the first gas burner unit 30 and the second gas burner unit 40 about the hinges so that the first gas burner unit 30 and the second gas burner unit 40 stand upright in the vertical direction so as to face each other or are spread in the horizontal direction outwards from the drip pan guide unit 10 interposed therebetween. The first gas burner unit 30 is provided at one side wall thereof with insertion guide members 32, which are spaced a predetermined distance apart from each other. The second gas burner unit 40 is provided at one side wall thereof with insertion guide members 42, which are spaced a predetermined distance apart from each other. The insertion guide members 32 and 42 are configured to receive insertion protrusions 52 and 52*a* of the heat guide unit 50 therein, which will be described below. Non-described reference numerals 33 and 43 denote flame adjustment knobs.

The heat guide unit 50 is formed in a reverse "U" shape having an open left surface, an open right surface and an open bottom surface. The heat guide unit 50 has a gridiron insertion slot 51 formed in the top surface thereof, through which a separate gridiron is inserted into the heat guide unit 50 in the vertical direction. The heat guide unit 50 has insertion protrusions 52 formed at the left-front edge portion and the left-rear edge portion thereof and insertion protrusions 52*a* formed at the right-front edge portion and the right-rear edge portion thereof. The insertion protrusions 52 and 52*a* extend in the vertical direction. As a result of the insertion protrusions 52 and 52*a* of the heat guide unit 50 being inserted into the insertion guide members 32 and 42 of the first gas burner unit 30 and the second gas burner unit 40, the first gas burner unit 30 and the second gas burner unit 40 are maintained in the upright standing state. When the heat guide unit 50 is lifted up such that the insertion protrusions 52 and 52*a* are withdrawn out of the insertion guide members 32 and 42, the first gas burner unit 30 and the second gas burner unit 40 are rotated from the upright standing state and spread outwards in the horizontal direction.

The oven unit 60 may be formed in a rectangular parallelepiped shape having an open bottom surface. The oven unit 60 has an opening 61 formed in the top surface thereof and an opening 61*a* formed in the front surface thereof. The oven unit 60 is provided with doors 63 and 63*a*, which are rotatably connected with the outer surfaces of walls 65 defining the external appearance of the oven unit 60 by means of hinges 62 in order to open and close the openings 61 and 61*a*. Each of the lateral walls 65 of the oven unit 60 is divided into a plurality of parts, which are connected with the walls 65 and with each other by means of hinges 66 so as to be folded inwardly.

The oven support unit 70 is mounted below the oven unit 60 in order to support the oven unit 60. The oven support unit 70 includes four side walls 71 having predetermined heights. The oven support unit 70 has an open top surface and a heat guide slot 72 formed in the lower end portion thereof. The lower end portion of the oven support unit 70, in which the heat guide slot 72 is formed, is inserted into the gridiron insertion slot 51 formed in the top surface of the heat guide unit 50. The oven support unit 70 is provided with a grill 64, which is removably received in the upper end portion of the oven support unit 70.

Hereinafter, the operational effect of the roaster usable as a stove according to the present invention will be described.

Figure 5:
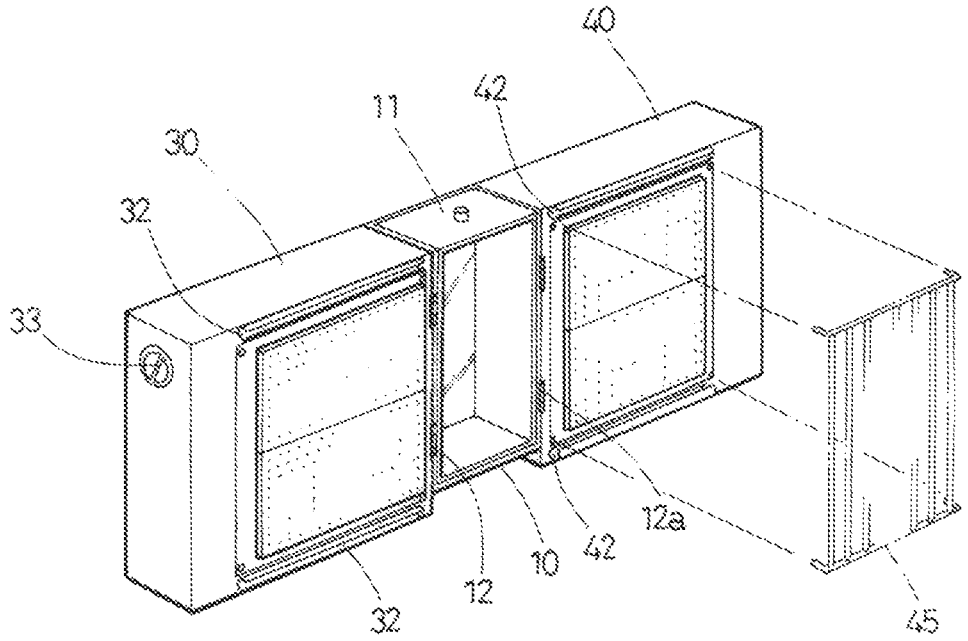
FIG. 5 is a perspective view illustrating the state in which the first gas burner unit and the second gas burner unit according to the present invention are erected upright so as to be used as a stove for heating a surrounding space.

When the roaster usable as a stove according to the present invention is intended to be used as a stove for heating a surrounding space, the heat guide unit 50, the oven unit 60 and the oven support unit 70 are first removed, and, as shown in FIG. 5, the first gas burner unit 30, the second gas burner unit 40 and the drip pan guide unit 50 are erected upright so as to radiate heat laterally toward a user. Finally, safety meshes 45 are mounted to the first and second gas burner units 30 and 40, enabling the user to use the roaster of the present invention as a stove for heating a surrounding space.

Figure 4:
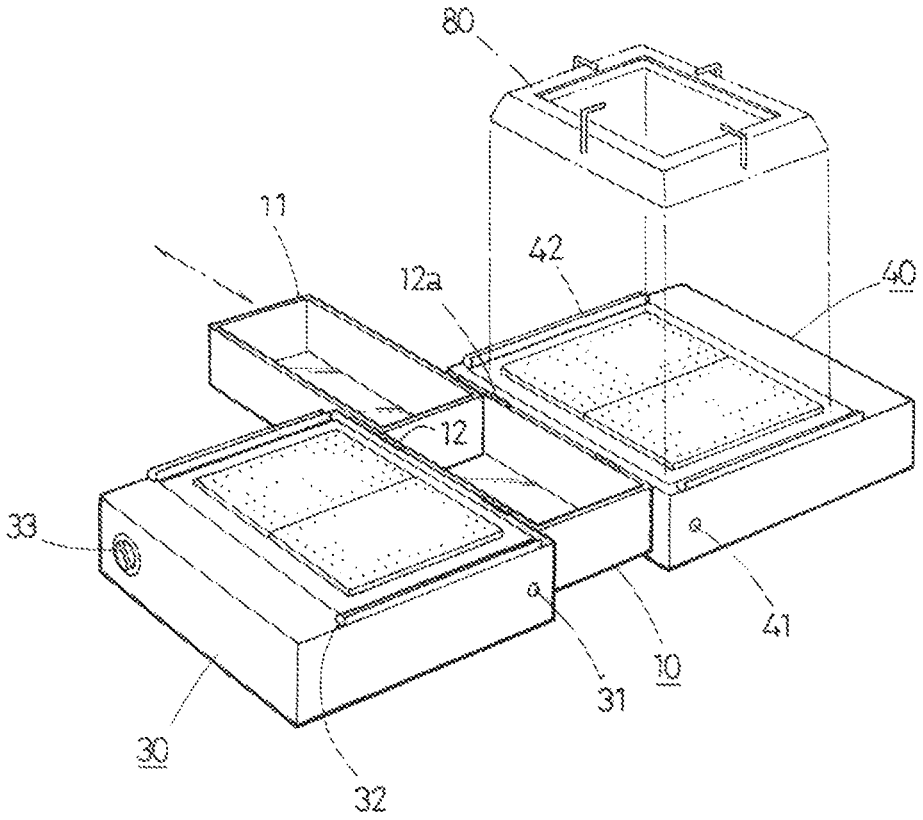
FIG. 4 is a perspective view illustrating the state in which the first gas burner unit and the second gas burner unit according to the present invention are laid down and spread laterally so as to be used as a burner.

When the roaster usable as a stove according to the present invention is intended to be used as a gas burner for heating a cooking utensil placed thereon, the heat guide unit 50, the oven unit 60 and the oven support unit 70 are first removed, and, as shown in FIG. 4, the first gas burner unit 30, the second gas burner unit 40 and the drip pan guide unit 10 are laid down so as to radiate heat upwards. Finally, trivets 80, on which cooking utensils for cooking food are placed, are put on the top surfaces of the first and second gas burner units 30 and 40, enabling the user to use the roaster of the present invention as a gas burner.

Figure 3:
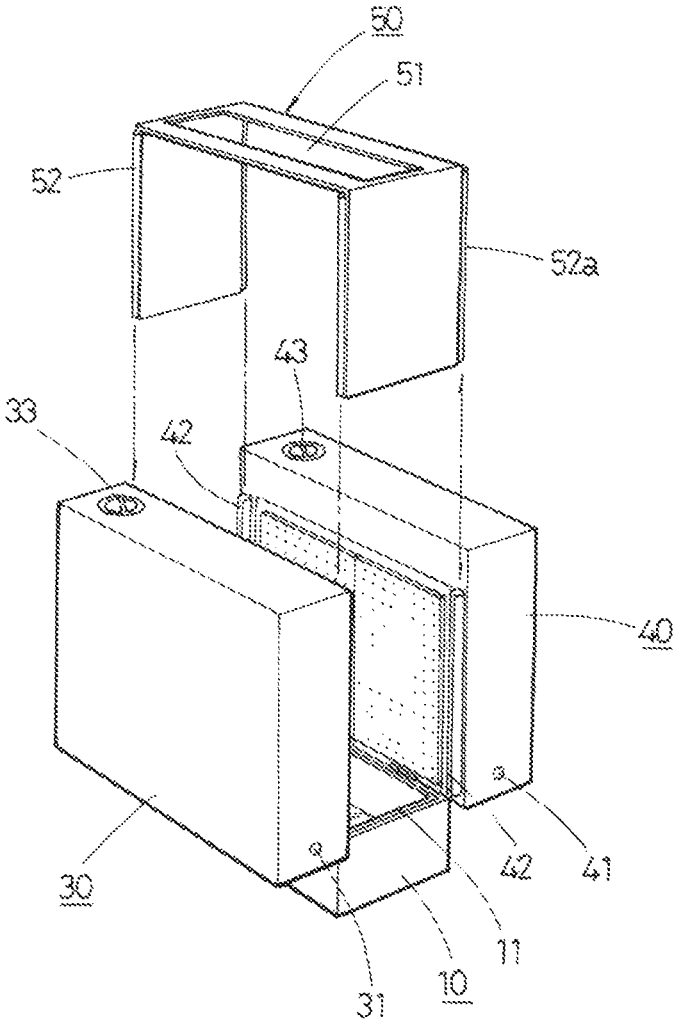
FIG. 3 is an exploded perspective view illustrating a first gas burner unit, a second gas burner unit and a heat guide unit according to the present invention.

When the roaster usable as a stove according to the present invention is intended to be used as a roaster, as shown in FIG. 3, the first gas burner unit 30 and the second gas burner unit 40 are rotated upwards about the hinges 12 and 12*a* from the laid-down state shown in FIG. 4. In this state, the heat guide unit 50 is assembled with the first gas burner unit 30 and the second gas burner unit 40 in a manner such that the insertion protrusions 52 and 52*a* of the heat guide unit 50 are inserted into the insertion guide members 32 and 42 of the first gas burner unit 30 and the second gas burner unit 40, whereby the first gas burner unit 30 and the second gas burner unit 40 are maintained in the upright standing state in which they radiate heat toward the heat guide unit 50 interposed therebetween. When a gridiron (not shown), on which food materials to be roasted are held, is inserted downwards into the heat guide unit 50 through the gridiron insertion slot 51 formed in the top surface of the heat guide unit 50, the food materials held by the gridiron are roasted by heat radiated from the first gas burner unit 30 and the second gas burner unit 40. Liquid fat from the roasted food materials drips and is collected in the drip pan 11. In the above-described way, the user can obtain a roaster function.

When the oven unit 60 is mounted to the roaster usable as a stove according to the present invention, it is possible to obtain an oven function of heating meat, potatoes, sweet potatoes, etc. placed therein. In order to use the oven unit 60, the gridiron, which has been inserted into the heat guide unit 50 through the gridiron insertion slot 51, is removed. Subsequently, the lower end portion of the oven support unit 70 is inserted into the gridiron insertion slot 51 in the heat guide unit 50, and the oven unit 60 is mounted onto the oven support unit 70. When the user intends to heat meat, potatoes, sweet potatoes, etc. using the oven unit 60, the user may place such food materials on the grill 64 provided inside the oven unit 60 and may close the doors 63 and 63*a*. Since the oven unit 60 is spaced a predetermined distance apart from the zone that is directly affected by the heat generated by the first gas burner unit 30 and the second gas burner unit 40, the oven unit 60 achieves the oven function using indirect heat (i.e. heat transferred through the heat guide unit 50 and the oven support unit 70 from the first gas burner unit 30 and the second gas burner unit 40).

As described above, the roaster usable as a stove according to the present invention having the above construction is capable of being transformed between a stove for heating a surrounding space and a burner for cooking food outdoors or indoors by simple manipulation on the part of a user, of also serving as a roaster for roasting food or an oven for heating food, and of being easily disassembled and assembled, leading to convenience in carrying or storing the same.

As is apparent from the above description, the roaster usable as a stove according to the present invention has the following effects.

First, the roaster of the present invention may be used as a stove for heating a surrounding space by erecting the first gas burner unit and the second gas burner unit upright so as to radiate heat laterally.

Second, the roaster of the present invention may be used as a gas burner by laying down the first gas burner unit and the second gas burner unit so as to radiate heat upwards and to cook food placed thereon.

Third, the roaster of the present invention may be used as a roaster by rotating the first gas burner unit and the second gas burner unit upwards and maintaining the upright standing state thereof by interposing the heat guide unit therebetween so as to roast food held by the gridiron that is inserted vertically into the heat guide unit.

Fourth, the roaster of the present invention may be used as an oven by removing the gridiron from the heat guide unit and mounting the oven unit onto the heat guide unit so as to heat meat, potatoes, sweet potatoes, etc. placed on the grill provided inside the oven unit.

Fifth, the constituent components of the roaster of the present invention are easily disassembled from each other and folded to a compact size, making it easy to carry or store them.

In conclusion, the roaster usable as a stove according to the present invention has an effect of facilitating transformation suitable for respective purposes of use, such as a stove for heating a surrounding space, a gas burner, a roaster and an oven.

It is to be understood that the phraseology and terminology used in the specification and appended claims should not be construed as being limited to general and dictionary meanings but should be construed as having meanings and concepts according to the spirit of the present invention on the basis of the principle that the inventor is permitted to define appropriate terms for the best explanation.

The preferred embodiments described in the specification and shown in the accompanying drawings are illustrative only and are not intended to represent all aspects of the invention, and thus it is to be understood that various equivalents and modifications can be made without departing from the spirit of the invention.

What is claimed is:

1. A roaster usable as a stove comprising:

a drip pan guide unit formed to have an open top surface and an open rear surface;

a drip pan formed in a box shape having an open top surface and configured to be received in or withdrawn out of the drip pan guide unit;

a first gas burner unit hingedly connected with one side wall of the drip pan guide unit and provided at one surface thereof with insertion guide members spaced a predetermined distance apart from each other, and a second gas burner unit hingedly connected with an opposite side wall of the drip pan guide unit and provided at one surface thereof with insertion guide members spaced a predetermined distance apart from each other;

a heat guide unit formed in a reverse "U" shape having an open left surface, an open right surface and an open bottom surface, the heat guide unit having a gridiron insertion slot formed in a top surface thereof and insertion protrusions formed at left-front, left-rear, right-front and right-rear edge portions thereof, and the insertion protrusions being inserted into the insertion guide members so that the first gas burner unit and the second gas burner unit are maintained in an upright standing state or being withdrawn out of the insertion guide members so that the first gas burner unit and the second gas burner unit are rotated from the upright standing state and spread outwards in a horizontal direction;

an oven unit formed to have an open bottom surface and openings formed in top and front surfaces thereof, the oven unit including a first door and a second door hingedly connected with outer surfaces of walls thereof in order to open and close the openings, and two opposite lateral walls, each being divided into a plurality of parts hingedly connected with each other so as to be folded inwardly, and the oven unit being provided at an interior thereof with a grill; and an oven support unit mounted below the oven unit in order to support the oven unit, the oven support unit including walls having predetermined heights, an open top surface, and a heat guide slot formed in a lower end portion thereof, and the lower end portion of the oven support unit being inserted into the gridiron insertion slot.

* * * * *